United States Patent [19]

Horton

[11] Patent Number: 5,060,422

[45] Date of Patent: Oct. 29, 1991

[54] WEATHERSTRIP

[75] Inventor: Robert C. Horton, Canandaigua, N.Y.

[73] Assignee: Ultrafab, Inc., Farmington, N.Y.

[21] Appl. No.: 615,084

[22] Filed: Nov. 19, 1990

[51] Int. Cl.[5] ..... E06B 7/16

[52] U.S. Cl. ..... 49/489

[58] Field of Search ..... 49/489, 490, 475

[56] References Cited

U.S. PATENT DOCUMENTS

| | | | |
|---|---|---|---|
| Re. 31, 403 | 10/1983 | Burrous . | |
| 3,745,053 | 7/1973 | Johnson et al. . | |
| 3,836,421 | 9/1974 | Terry | 49/489 X |
| 4,148,953 | 4/1979 | Horton . | |
| 4,164,599 | 8/1979 | Kessler | 49/489 X |
| 4,242,392 | 12/1980 | Yackiw . | |
| 4,288,482 | 9/1981 | Beck | 49/489 X |
| 4,305,984 | 12/1981 | Boyce | 49/489 X |
| 4,352,845 | 10/1982 | Miska | 49/489 X |
| 4,358,497 | 11/1982 | Miska | 49/489 X |
| 4,754,589 | 7/1988 | Leth | 49/475 X |

*Primary Examiner*—Rodney M. Lindsey
*Assistant Examiner*—Jerry Redman
*Attorney, Agent, or Firm*—Martin Lukacher

[57] ABSTRACT

A weatherstrip having a backing member and a pair of rows of pile of different height above said backing strip. A flexible fin is disposed between said rows and has a height equal or slightly greater than the height of the higher row. When sash members, such as those of a horizontal sliding window move into closing relationship, the fin bends causing bending of the higher row forming a seal between the sash members while the row of lower height is not substantially compressed and provides a springlike force opposing the mechanism which holds the sliding sash.

5 Claims, 1 Drawing Sheet

WEATHERSTRIP

DESCRIPTION

Figure 1:
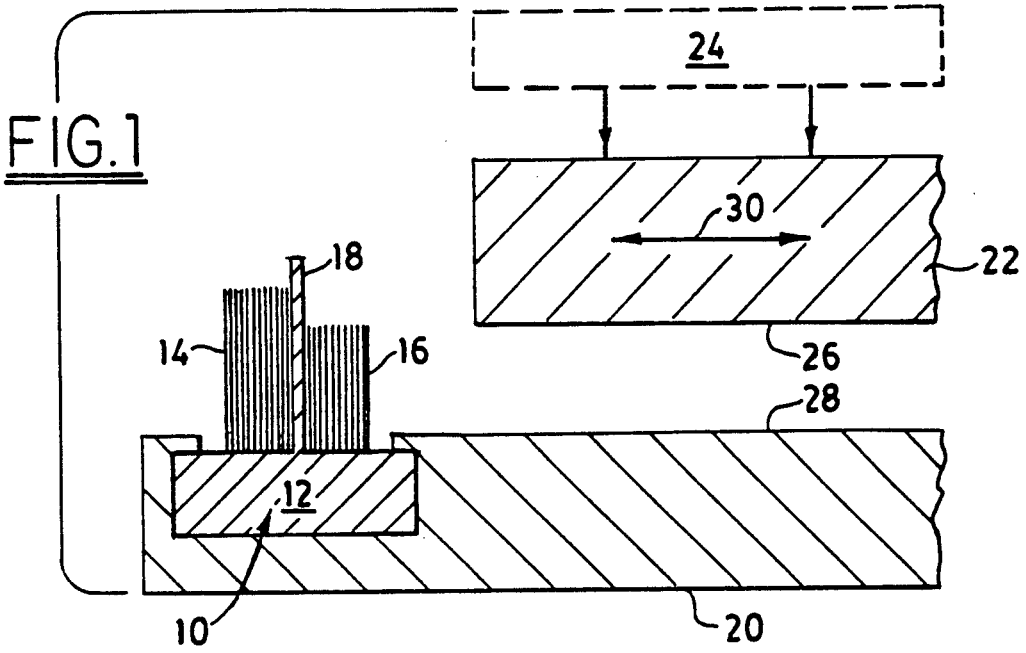

The present invention relates to weatherstrip and particularly weatherstrip having a flexible fin extending between rows of material, the relative heights of the rows being different so as to enable the flexible fin to form an effective airtight seal between members which move into closing relationship, such as the sash members of a horizontal sliding window or door, when the members come into closing relationship.

Various types of weatherstrip with fins have heretofore been suggested. Reference may be had to U.S. Pat. Nos. 3,745,053 issued July 10, 1973, RE 31,403 issued Oct. 4, 1983, Horton U.S. Pat. No. 4,148,953 issued April 10, 1979, and 4,242,392 issued Dec. 30, 1980 for showings of weatherstrips having rows of material, usually pile, between which are flexible or frangible (non-self-supporting) fins or membranes. Such existing weatherstrips while providing effective seals have the disadvantage of either providing too little or too much force between the opposing members which are to be sealed by the weatherstrip. In some instances the weatherstrip applies excessive drag on the members to be sealed and retards them from being easily opened and closed. In other instances, reliance on seal forming is left to the fin or membrane, the pile not being substantially compressed. While then the door or window is not retarded in its movement, insufficient holding force is applied to the movable member (the weatherstripping usually being fixedly mounted in the stationary member) and the movable member is not firmly held in position causing rattling and imperfect seals.

It is the principal object of the present invention to provide an improved weatherstrip wherein the foregoing difficulties and disadvantages are substantially obviated.

It is a more specific object of the present invention to provide an improved weatherstrip having two rows of pile attached to a backing strip and extending longitudinally along that strip. A fin preferably of air and water impervious material is attached to the backing strip and extends upwardly between the rows. The fin preferably is frangible (not stiff enough to be self-supporting) and is supported in upright position by and between the rows. One of the rows is higher than the other and the fin is of a height equal to or slightly greater than the height of the higher row. The lower row is of a height which is adapted to compress slightly, but not substantially, when the members which are sealed by the weatherstrip (for example, the sash of a movable, usually slidable, window or door and its cooperating fixed sash member). Accordingly, when the movable and fixed members come into closing relationship, the fin is bent and bends the higher row while the lower row supports the movable member and prevents the movable member from shaking or rattling. The seal is provided principally between the higher row and the fin while the other row principally provides a supporting function.

Figure 2:
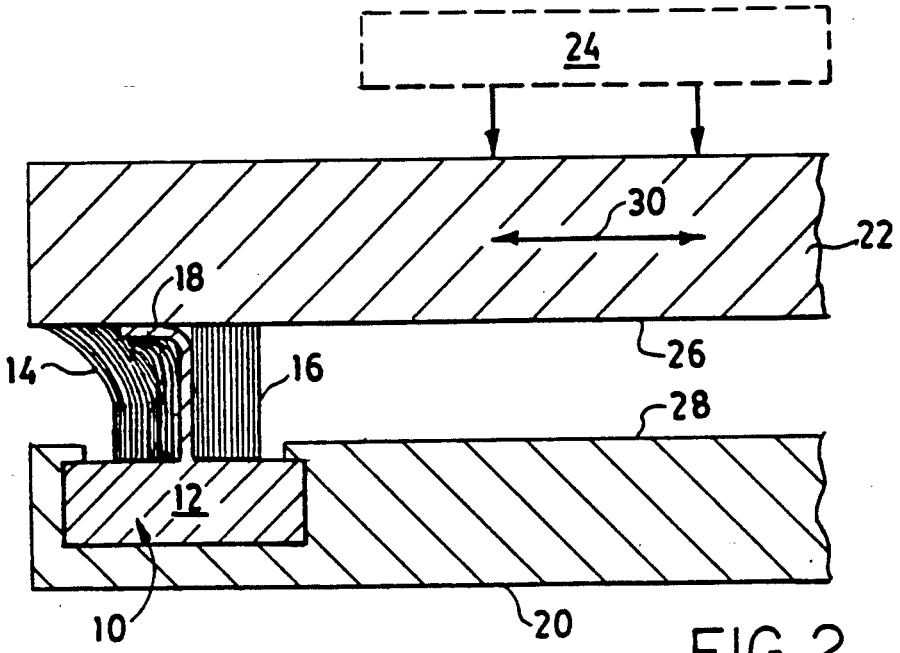

The foregoing and other objects features advantages of the invention as well as a presently preferred embodiment thereof will become more apparent from a reading of the following description in connection with the accompanying drawings in which:

FIG. 1 is a diagrammatic view of a sliding window or door with a weatherstrip installed in the fixed member of the door or window before it is moved into closing position; and FIG. 2 is a view similar to FIG. 1 showing the door or window in closed position.

Consider first the weatherstrip 10. It has a backing strip 12 to which two rows of flexible sealing material, preferably piles of upright fibers, are mounted. The techniques used in the patents cited above may be used to make this weatherstrip. One of the rows is higher than the other. Between the rows 14 and 16 there is a fin or membrane 18 which is of a height equal to or slightly greater than (as shown) the height of the taller row 14 above the backing strip 12. The fin 18 may be attached in the manner described in any of the above cited patents. It will be appreciated that the weatherstrip extends longitudinally the entire width (in a direction into and out of the paper on which the FIGURES are drawn) of the fixed member 20 of the sash of the door or window. The movable member (the window or door) 22 is held in a holding mechanism, such as a door frame having rollers or positioning buttons. This holding mechanism is indicated schematically at 24 and applies a force on the movable member 22 in a direction towards the fixed member. It will be appreciated that the weatherstrip is mounted in a groove in the fixed member as shown or in any other conventional manner.

The action of the weatherstrip in providing an improved seal and in supporting and positioning the window or door will become more apparent from FIG. 2. There, the window or door 22 has been moved into closing relationship with the fixed member 20. In the course of such movement, because the gap between the opposing surfaces 26 and 28 of the window 22 and the fixed member 20 is less than the height of the higher row 14 of pile but equal or slightly less than the height of the shorter row 16 (above the surface 28), the fin is first bent. Then it bends and compresses the higher row 14. This forms a tight and effective seal without applying excessive force to the movable member 22 and allowing it to be moved easily (without undesirable break away force) into open and closed position in the direction, shown by the two-headed arrow 30. On closing the other row 16 is not substantially compressed. However, it is sufficiently compressed to exert a holding force against the holding mechanism. The row 14 which is bent and over which the fin 18 lies is narrow in width and insufficient to develope a force against the force applied by the holding mechanism 24. The other row 16 provides the necessary additional force to hold the window or door 22 against the holding mechanism. The seal between the surfaces 26 and 28 is provided by the row 14 and the fin and is an effective seal since the height of the fin and the row 14 extends well beyond the gap between the surfaces 28. The other row 16 provides an effective support for the window or door so as to prevent rattling. The additional force is not such as to substantially increase the break away force which is the highest force necessary to open the window or door 22.

From the foregoing description it will be apparent that there has been provided an improved weatherstrip. Variations and modifications within the scope of the invention will undoubtedly suggest themselves to those skilled in the art. Accordingly, the foregoing description should be taken as illustrative and not in a limiting sense.

I claim:

1. A weatherstrip which comprises a backing member extending longitudinally, first and second rows of flexible sealing material attached to said backing member and extending longitudinally along said backing member, said first and second rows projecting away from said backing member respectively providing a seal and support between opposing surfaces of a pair of members which move relatively into and out of closing relationship with each other, said weatherstrip being adapted to be fixedly attached to one of said pair of members, a fin of flexible material attached to said backing strip and disposed between said rows and extending longitudinally along said backing strip, said second of said rows projecting in height a greater distance from said backing strip and the opposing surface of the member in which it is disposed than said first row, said flexible fin projecting a distance equal or slightly greater than the height of said second row whereby said fin is bent over said second row, bending said second row to form a seal between the opposing surfaces of said members when said members come together into closing relationship.

2. The weatherstrip according to claim 1 wherein said other of said pair of members is held by a holding mechanism and wherein said first row projects to a height sufficient to engage the other of said pair of members so as to be compressed without substantial bending to provide force against the other of said pair of members in a direction against said holding mechanism whereby to hold said other of said pair of members against lateral movement which may manifest itself as a rattle.

3. The weatherstrip according to claim 2 wherein said fin is of a non-self-supporting material and is supported in upright position by and between said rows.

4. The weatherstrip according to claim 3 wherein said fin is impervious to air and water.

5. The weatherstrip according to claim 1 wherein said rows are of fibers forming piles.

* * * * *